US005575429A

United States Patent [19]

Muller-Girard

[11] Patent Number: 5,575,429

[45] Date of Patent: Nov. 19, 1996

[54] CONTROL APPARATUS FOR FLUORESCENT LAMP CRUSHER

[75] Inventor: Otto Muller-Girard, Rochester, N.Y.

[73] Assignee: Dextrite, Inc., Rochester, N.Y.

[21] Appl. No.: 395,130

[22] Filed: Feb. 27, 1995

[51] Int. Cl.[6] ..... B02C 19/12; B02C 23/04

[52] U.S. Cl. ..... 241/36; 241/37.5; 241/99; 241/100; 241/DIG. 14

[58] Field of Search ..... 241/34, 36, 99, 241/100, DIG. 14, 37.5; 340/635

[56] References Cited

U.S. PATENT DOCUMENTS

| | | | |
|---|---|---|---|
| 3,623,672 | 11/1971 | DeFrank | 241/36 |
| 4,545,540 | 10/1985 | Nakamura | 241/99 |
| 4,579,287 | 4/1986 | Brown | 241/36 |
| 4,607,798 | 8/1986 | Odlin | 241/99 |
| 4,655,404 | 4/1987 | DeKlerow | 241/99 |
| 5,205,497 | 4/1993 | DeKlerow | 241/36 |
| 5,492,278 | 2/1996 | Raboin | 241/57 |

*Primary Examiner*—John M. Husar

*Attorney, Agent, or Firm*—Shlesinger, Fitzsimmons, Shlesinger

[57] ABSTRACT

As each tube is fed into the feed chute of a fluorescent lamp tube crusher, and regardless of the size of the tube, a sensor switch in the chute immediately sends a count signal to an associated tube counter, and also produces an inhibit signal which prevents a second count signal from being applied to the counter for a predetermined interval of time that is greater than the time it takes to grind up a tube of a first size and that is less than the time it takes to crush a tube of larger size. If at the end of the interval a tube of larger size is still being crushed, a second count signal is applied to the counter.

14 Claims, 3 Drawing Sheets

CONTROL APPARATUS FOR FLUORESCENT LAMP CRUSHER

BACKGROUND OF THE INVENTION

This invention relates to fluorescent lamp crushers, and more particularly to crushers of the type that are designed to crush fluorescent lamp tubes of various lengths and shapes. Even more particularly this invention relates to improved control apparatus for automatically sensing the overall length of each tube inserted into the crusher, and for simultaneously counting incremental lengths of the tubes inserted into the crusher.

Fluorescent tubes or lamps of the type described frequently are marketed in two different shapes—namely, straight or linear, and curved or U-shaped in configuration. Moreover, such tubes normally are marketed in three different lengths—namely, four feet long or eight feet long for the linear or straight tubes, and two feet overall for the U-shaped tubes. The straight tubes which are eight feet in length contain twice as much glass and mercury vapor as each of the straight four foot tubes and U-shaped tubes. Typically tubes of the type described are crushed in fluorescent apparatus of the type disclosed in the U.S. Pat. No. 4,655,404, wherein any toxic mercury vapors, which are released upon the crushing of such tubes, are drawn into and absorbed by a special filter that which is associated with such apparatus.

However, it has been found necessary periodically to change the filter element in crushers of the type noted above, because after prolonged use the filter element becomes saturated and thereafter fails to function properly. For that reason, as noted in the U.S. Pat. No. 5,205,497, it has been customary to employ in connection with such crushers a safety device which prevents further operation of the crusher after a predetermined successive number of lamps have been crushed. In that prior art control apparatus the feed tube, which guides the fluorescent lamp tubes into the crusher, contains a normally-open switch that is closed each time a new tube is inserted into the crusher. The intermittently operated switch operates a counter, which after a predetermined number of counts have been made, interrupts the operation of the crusher until the filter element is replaced. However, this mechanism result in to inaccurate counting, because of the breaking of some fluorescent tubes upon movement of the tubes into the machine feed chute. The effect of such breaking is to create multiple operation of the normally-open switch employed to count the number of tubes inserted into the machine, and therefore frequently has led to an excessive count, and premature replacement of the filter element.

To obviate the foregoing problem, crusher machines have been equipped heretofore with a manually-operated tube size selector switch, which the machine operator actuated at the time the tube was inserted into the crusher machine to indicate whether the tube was a four foot tube, an eight foot tube or a U-shaped tube. If the operator properly operated the tube size selector switch, the mechanism produced an accurate account representing the volume of the crushed tubes, and consequently an accurate representation of the crushed glass and mercury vapor released per tube. However, the accuracy depended upon the conscientious operation of the tube size selector switch, and if the machine operator failed properly to operate the selector, then the count was inaccurate. Moreover, this created the possiblity that the operator could deliberately fail to make the correct tube size selection for the purpose of prolonging the useful life of the associated filter element, in which case the element very often could be operated after reaching its saturation point.

It is an object of this invention, therefore, to provide an improved control apparatus for crushers of the type described, which will provide a far more accurate measure of the crushed glass and vapor created by the crusher subsequent to the insertion of the filter element therein, and which will prevent any deliberate operation of the crusher after its associated filter element has become saturated.

A more specific object of this invention is to provide improved crusher apparatus of the type described which, in effect, automatically and accurately senses the type of fluorescent tube which is inserted into the machine, and which, regardless of the size and shape of the tube inserted, provides an accurate count for each predetermined quantity of crushed glass and mercury vapor released into the crusher.

Still another object of this invention is to provide for fluorescent lamp crushers of the type described improved control apparatus which includes means for automatically sensing the insertion of long and short tubes into the crusher, including U-shaped tubes, and which prevents any multiple or accidental triggering thereof.

Other objects of the invention will be apparent hereinafter from the specification and from the recital of the appended claims, particularly when read in conjunction with the accompanying drawing.

SUMMARY OF THE INVENTION

Study of the operation of the associated tube sensing switch during repeated crushings of four foot, eight foot and U-shaped tubes in apparatus of the type disclosed in the above-noted U.S. Pat. No. 5,205,497 (hereinafter the '497 patent) established empirically that each of the three different types of tube produced a different ON/OFF signature or pattern of the sensor switch. For example, for each type of tube, it took an empirically predetermined interval of time between the initial closing of the switch upon insertion of a tube into the feed chute of the mechanism, and the final opening of the switch after all portions of a given tube had been crushed. Although the switch may have intermittently opened and closed during such interval because of outside interference or noise, a signature interval for each of the three different types of tubes was established.

To provide an accurate count (one count for each four foot length of tube crushed) a timer controlled circuit was devised based upon the three signatures noted above. Two of the signature intervals (for four foot and U-shaped tubes) were similar, while the interval for the eight foot tube was approximately double that of the four foot and U-shaped tubes. Consequently the timer controlled circuit utilizes one timer for producing one counter signal for each four foot or U-shaped tube, and two successive counter signals for each eight foot tube. A second timer functions to inhibit the production of a second successive counter signal unless the sensor switch remains closed continuously for an interval of time that falls between the four foot and U-shaped tube interval, and the eight foot interval.

THE DRAWINGS

Figure 4:
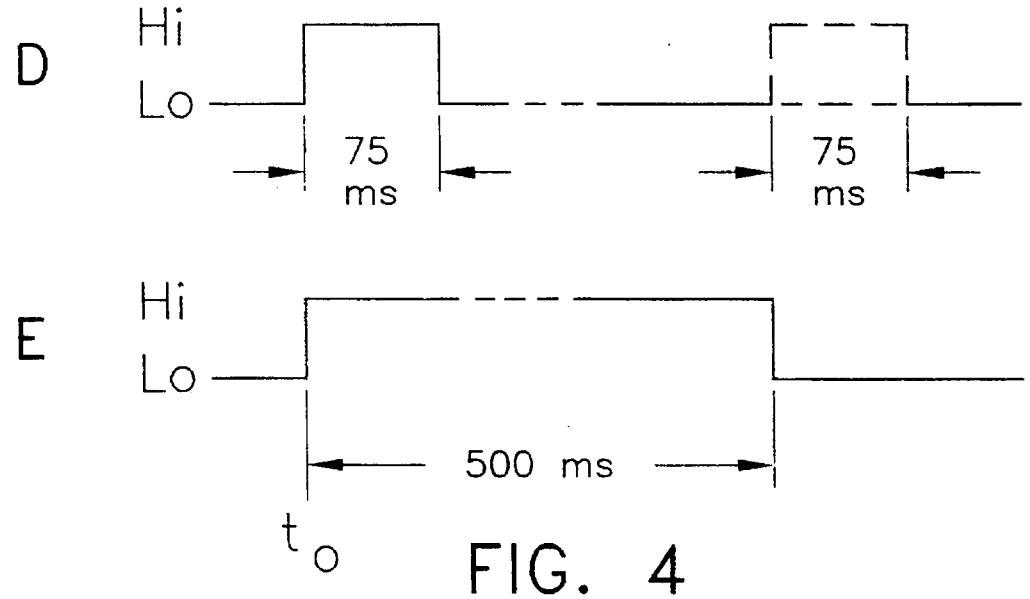
Figure 5:
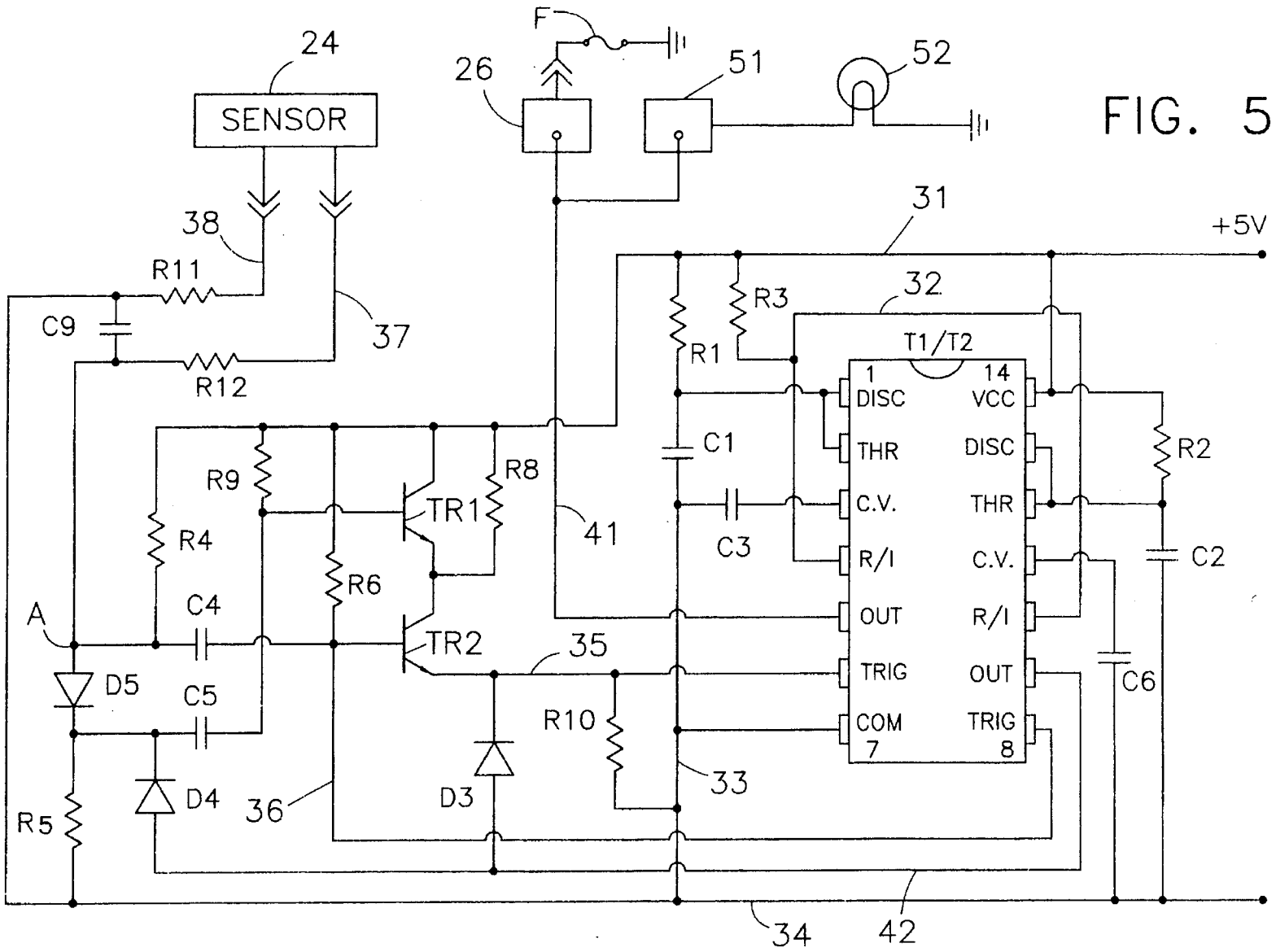

FIG. 4 is a graphic illustration of the two different signal outputs which are generated by the dual timer which forms part of the control apparatus described herein; and FIG. 5 is a wiring diagram illustrating the overall control apparatus employed for sensing and generating timer output or counter signals for four foot tubes, eight foot tubes and U-shaped tubes as the later are inserted into the crusher mechanism.

DETAILED DESCRIPTION OF THE PREFERRED EMBODIMENTS

Figure 2:
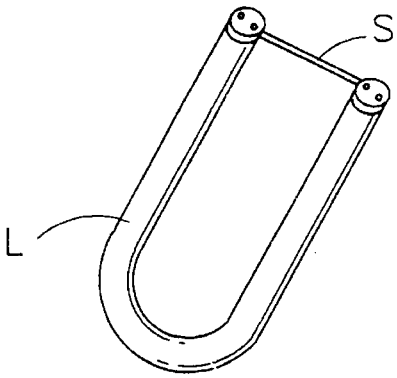
FIG. 2 is a perspective view of a U-shaped flourescent lamp of the type which is adapted to be crushed in a mechanism of the type shown in FIG. 1.
Figure 1:
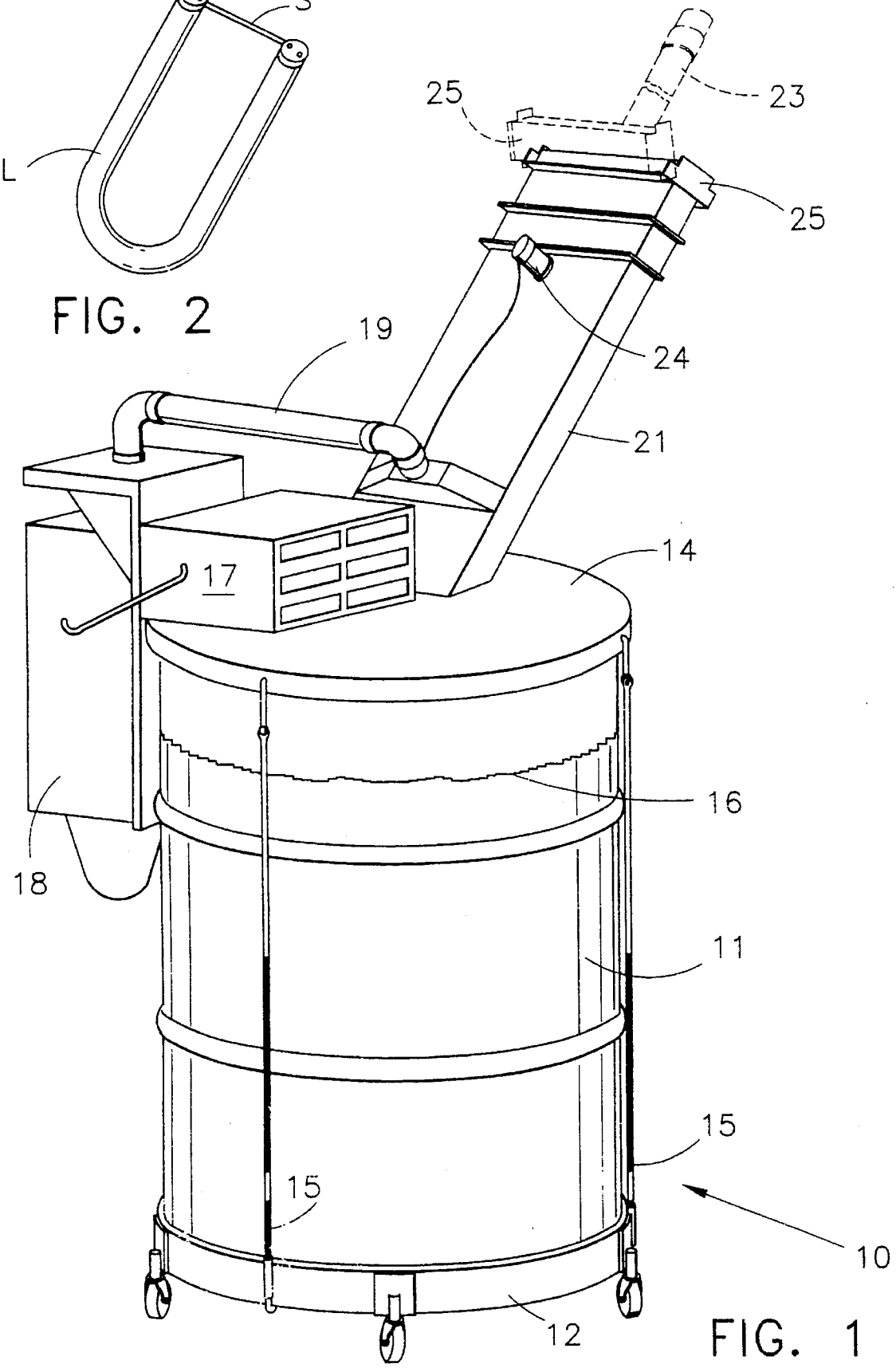
FIG. 1 is a perspective view illustrating in elevation a lamp crusher mechanism having incorporated therein improved control apparatus of the type made according to one embodiment of this invention, a removable tube guide for the crusher mechanism being shown fragmentarily and in phantom by broken lines.

Referring now to the drawings by numerals of reference, and first to FIGS. 1 and 2, 10 denotes generally a crusher mechanism which, for the most part, is generally similar to the crusher mechanism disclosed in the above-noted '497 patent. In this connection, a waste receptacle or drum 11 which is mounted on a wheeled carriage 12, has thereon a circular cover plate 14 secured by elastic cords 15 to the carriage 12. Numeral 16 denotes part of the plastic sleeve which is interposed between the drum 11 and the crusher housing (not illustrated), which is supported from the underside of cover 14. A control box 17 is mounted on the upper surface of cover 14 adjacent the filter housing 18, which is adapted to contain a removable filter element of the type referred to in my '497 patent. At its upper end the filter in housing 18 communicates with the outlet end of an exhaust pipe 19, the opposite end of which is connected to a fluorescent lamp feeder chute or guide 21.

Chute 21, which is different in configuration from the chute shown in the '497 patent, has a generally rectangular, cross sectional configuration. Its lower end communicates through an opening in cover 14 with the crusher mechanism (not illustrated); and its upper end normally is closed by a hinged brush element 25. Chute 21 is adapted to have inserted into its upper end through the strands of the brush element 25 U-shaped fluorescent tubes of the type denoted by the letter L in FIG. 2. At the open end of tube L its two, spaced leg sections are secured in spaced, parallel relation to each other by a metallic stiffener S, which prevents any undesirable bending of one leg section of the tube relative to the other. It is customary to insert the tube L through element 25 in such manner that the closed, curved lower end of the tube L is inserted first into the chute 21, and the stiffener S is therefore the last portion of the tube to enter the chute.

Shown in phantom and in broken lines in FIG. 1 is a cylindrically shaped feed tube adapter 23, which, after element 25 has been swung into its broken line position in FIG. 1, is removably insertable into the upper end of the chute 21 whenever it is desired to insert into the crusher mechanism linear or straight fluorescent tube sections, such as for example conventional four foot tubes or eight foot tubes. When the U-shaped tubes L are to be inserted into the chute 21 the tubular adapter 23, of course, is removed from the upper end of chute 21, and element 25 is swung back to its operative position (full lines in FIG. 1). The guide 23 forms no part of this invention, and therefore will not be described in greater detail herein. However, it is to be understood that the apparatus as illustrated in FIG. 1 is adapted to accommodate and to crush any one of at least three different types of tubes—namely, four foot, eight foot, or U-shaped tubes. Moreover, each such tube upon being inserted into the guide 21 will encounter and be sensed by a sensor switch 24, which is mounted on chute 21 intermediate the ends thereof. Sensor switch 24, as noted in greater detail hereinafter, is designed to be turned ON when it senses the presence of a fluorescent tube in the chute 21, and is designed to be in an OFF mode, when no such tube is present in chute 21.

As noted above, heretofore the sensing switch 24, whether mechanically operated, optically operated or ultrasonically operated—suffered from the same shortcoming, in that multiple or false operations of the switch tended to take place during a tube crushing operation. Consequently, therefore, it heretofore has been extremely difficult to provide an accurate count of the tubes that have been crushed over a given period of time. The importance of such count, as noted in the '497 patent, is that each filter element should be replaced after it has been exposed to a predetermined number of crushed fluorescent lamps. Therefore, it has become necessary to compensate for, or to avoid the introduction of false count signals, which are introduced by switch noise (random opening and closing of the sensing switch) during a crushing operation.

Figure 3:
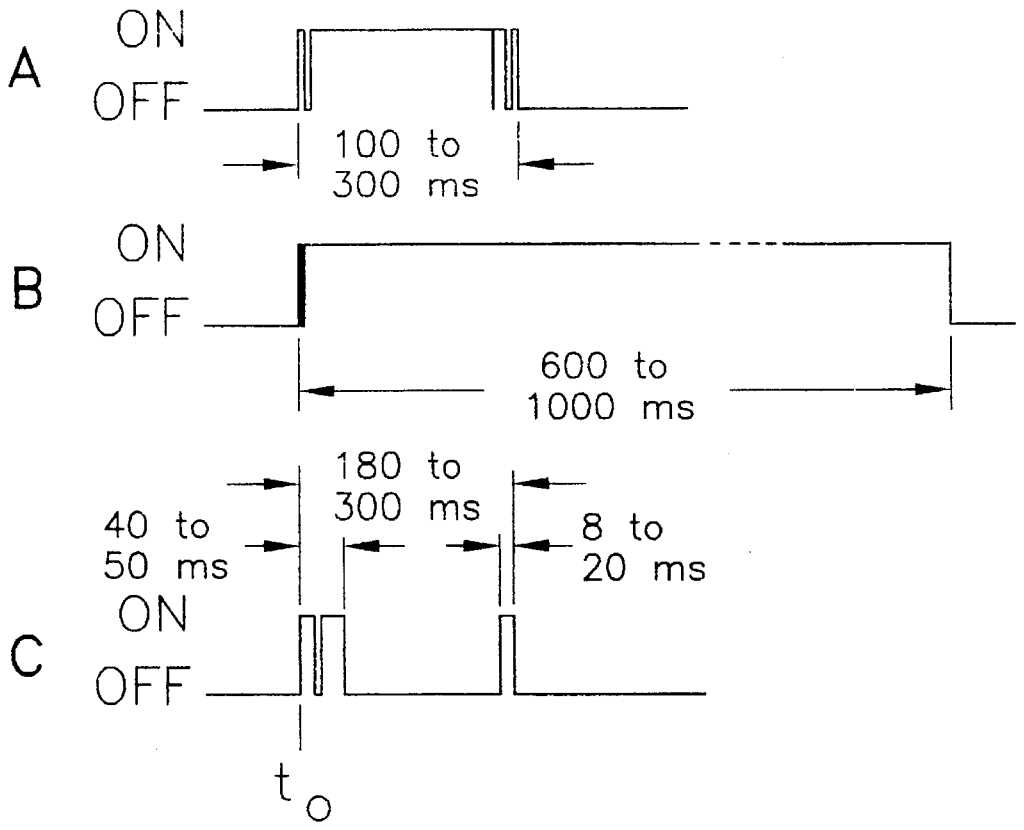
FIG. 3 illustrates graphically the ON/OFF intervals or signatures of the sensing switch of the herein described control apparatus upon insertion into the crusher mechanism of, respectively, a four foot tube, an eight foot tube and a U-shaped tube.

To effect this compensation, and over spaced intervals of time, each of a plurality of four foot, eight foot and U-shaped tubes were crushed in apparatus of the type shown in FIG. 1. The graphs A, B and C of FIG. 3 represent, respectively, the ON/OFF (closed/open) characteristics of the sensing switch 24 during the crushing of four foot, eight foot and U-shaped tubes, respectively. Graph A indicates that when four foot tubes are crushed, switch 24 is, generally speaking, consistently ON for anywhere from 100 to 300 milliseconds (ms). In the case of eight foot lamps (graph B), switch 24 is essentially ON for anywhere from 600 to 1,000 ms. On the other hand, in the case of U-shaped lamps, the switch 24 is on, initially, for approximately 40 to 50 ms, during the time that the closed end of the U-shaped lamp passes switch 24, after which switch 24 remains OFF for approximately 180 to 300 ms, except when the switch is momentarily ON (8 to 20 ms) as the stiffener S passes the switch 24. In addition to the noise generated, as shown in graph A, at the beginning and at the end of a crushing cycle for a four foot lamp, there might also be intermittent, brief opening and closing of the switch during the 100 to 300 ms interval, but the true signature for a 4 foot lamp is as illustrated in graph A. Likewise, although in addition to the brief noise shown at the beginning of the graphs B and C, these graphs reflect the true signatures of the switch 24 during the crushing of eight foot and U-shaped lamps, respectively.

Given the tube signatures as shown in FIG. 3, it was then possible to devise a circuit for counteracting or preventing undesirable operation of swtich 24. For example, referring to FIG. 4, any sensing of switch 24 in its ON mode, after a quiescent period, at $T_0$ causes a first timer of the type noted hereinafter to issue or create a 75 ms pulse to a counter, such as for example a counter noted in the above-noted '497 patent. At the same time, a 500 ms inhibiting pulse, which makes the first timer insensitive to any action of switch 24, is generated by a second timer of the type noted hereinafter. Then, if at the end of the 500 ms inhibition period, the sensing switch 24 is still closed, or in its ON mode, then another 75 ms output pulse is generated by the first timer in response to the termination of the second timer, thereby once again to produce a counter advancing signal.

More specifically, FIG. 5 illustrates a dual timer T1/T2, which is adapted to be connected in circuit between the sensor 24 and conventional counters 26 and 51, the former of which may function in the manner of the counter disclosed in the above-noted '497 patent. That is, counter 26 may be connected in circuit with the fuse (denoted at F in FIG. 5) that forms part of the filter element contained in housing 18. After counter 26 has received a predetermined number of counts, it will function to shut down the crushing mechanism of the apparatus shown in FIG. 1 until such time that the filter element is replaced with a new element. In the embodiment illustrated herein, the sensor 24 constitutes a proximity type tube sensing switch which, by way of example, may be of the capacitive sensor variety sold by Rechner Electronics Industries, Inc. under the article designation number 770600. It is to be understood, however, that other types of sensor switches, such as for example known mechanically or optically operated switches may be employed without departing from this invention.

The timers T1/T2 are energized from a DC 5 volt power supply through line 31, a resistor R3, and line 32 to each of the input terminals R/I for timers T1 and T2, respectively. Operation of the timers is completed by connecting terminal CV of timer T1 through capacitor C3 and line 33 to the common (negative) line 34, while the terminal CV of timer T2 is connected through the capacitor C6 also to the line 34. In addition to energizing the timers T1 and T2, the 5 v. power supply is applied through line 31 to the collector terminal of an NPN transistor TR1, and through a resistor R8 to the emitter of TR1, and to the collector terminal of a second NPN transistor TR2, the collector terminal of which is also connected to the emitter of TR1. The emitter terminal of transistor TR2 is connected by a line 35, and through a resistor R10 in line 33 to the common line 34. Also at this time the 5 v. power supply is applied by line 31 and the resistor R9 to the base of the transistor TR1, and by line 31 through a resistor R6 to the base of transistor TR2. As a consequence, both of the transistors TR1 and TR2 are biased forwardly, so that when the sensor switch 24 is open (OFF), current flows through the series connected emitter/collector circuits of the two transistors, and through line 35 resistor R10 and line 33 to ground line 34. As a consequence, at this time line 35 and the trigger terminal TRIG of timer T1, which is connected to line 35, are in a positive going mode. Likewise at this time the 5 v. power supply is supplied through line 31, resistor R6 and line 36 to the trigger terminal TRIG of the timer T2, so that this trigger terminal also is in a positive mode. Moreover, at this time current flow from the power supply through line 31, resistor R4, diode D5 and resistor R5 to line 34 causes node A of the control circuit to exhibit a positive going mode.

In the embodiment illustrated, one side of the proximity sensor switch 24 is connected by a line 37 through resistor R12 and the diode D5 and resistor R5 to line 34. The other side of switch 34 is connected through line 38 and resistor R11 to line 34. A capacitor C9 connected at one side to line 34 and at its opposite side between resistor R12 and point A of the circuit, along with resistors R11 and R12, are utilized in this embodiment simply for the purpose of suppressing radio frequency interference in the wires leading to the sensing switch 24, thereby to reduce or minimize any switching noise which might otherwise be created by such interference. Also, resistor R1 and capacitor C1 control the duration of the output signal produced as noted hereinafter by timer T1 (75 ms), while R2 and C2 control the duration of the signal (500 ms) produced by timer T2.

In any event, whenever the sensor switch 24 is closed (ON), it effectively shunts point A through resistors R12 and R11 to line 34, whereby the voltage at point A changes suddenly from a positive to a negative going voltage, such as for example from about 3.8 volts to approximately zero voltage. This sudden voltage change is communicated via a capacitor C4 simultaneously to the base of the transistor TR2 and to line 36. The negative going signal at the base of transistor TR2 momentarily turns off the transistor TR2, thereby creating a negative going signal via line 35 to the trigger terminal (TRIG) of the timer T1, at the same time that line 36 applies a negative-going signal to the triggering terminal of the timer T2. As a consequence, both the timers T1 and T2 are turned on simultaneously, with the output terminal (OUT) of timer T1 applying an output pulse of approximately 75 ms duration via the line 41 to the input of counter 26, at the same time that the output terminal (OUT) of timer T2 applies an output signal of a duration of approximately 500 ms through line 42 to the anodes of diodes D3 and D4. The cathode of diode D3 is connected to line 35, and the cathode of a diode D4 is connected through a capacitor C5 to the base of transistor TR1, and through resistor R5 to line 34. For the duration of the output signal from timer T2, the diode D3 conducts, thus maintaining line 35 in a positive going mode, thereby preventing transistor TR2 from conducting, and in turn inhibits T1 from again being triggered for the approximately 500 ms duration of the output signal of timer T2. This duration is illustrated in FIG. 4 by graph E.

If the sensor 24 was closed (turned ON) by virtue of the insertion of a short or four foot tube into the crusher, then approximately 100 to 300 ms after insertion of the tube into the crusher mechanism the sensor switch 24 will open and the voltage of point A will return to a positive going mode, with current now flowing through the diode D5 and resistor R5 to line 34. As soon as the diode D5 once again begins to conduct (at the end of the 100 to 300 ms duration) it will cause a positive going voltage to appear at the cathode terminal of the diode D4, thereby interrupting current flow through diode D4 and consequently interrupting the transmission of the output signal of timer T2 through diode D4. Therefore, by the time that the 500 ms output signal from the timer T2 expires, only one trigger signal will have been applied by timer T1 through line 41 to the counter 26.

If instead of inserting a 4 foot tube into the machine, a U-shaped tube has been fed into the machine, then within the 180 to 300 ms that it takes for the U-shaped tube to pass through the chute 24 and beyond the sensor 24, it will be noted from the above description that the approximate 500 ms output signal from the timer T2 inhibits or otherwise prevents timer T1 from producing any more than a single output signal on line 41. Thus, when the U-shaped tube is initially inserted into chute 24 it will momentarily close or turn ON the sensor switch 24, as shown for example by graph C in FIG. 3 and therefore will momentarily (at least for approximately 40 to 50 ms) cause point A to drop to near zero voltage, and therefore will trigger both the timers T1 and T2. One count signal will therefore be applied by line 41 to the counter 26 within the initial period of time that the sensor 24 is closed, but because of the inhibiting effect of the 500 ms signal output from the timer T2, no additional count signal will be applied to line 41 at any time during the overall interval of time it takes (180 to 300 ms) for the U-shaped tube to complete its passage beyond the sensor switch 24.

On the other hand, if instead of a short tube having been inserted into the crusher mechanism, a long, eight foot tube had been inserted, then the sensor switch 24 would have remained closed for essentially anywhere from 600 to 1,000 ms, so that at the time that the timer T2 output signal expired, approximately 500 ms after the closing of the sensor switch, point A in the circuit would still be in a negative going mode. As a consequence, diode D5 would have no influence upon the voltage existing at the cathode side of the diode D4, which would now be governed by the output of timer T2. Therefore, at the time that the output signal from timer T2 expires, voltage on line 42 and at the output of D4 will drop to nearly zero. That change in voltage is communicated via capacitor C5 to the base of transistor TR1, thereby momentarily interrupting the conduction through transistor TR1. When TR1 ceases to conduct, TR2 is starved of supply voltage at its collector terminal, thereby causing the emitter voltage of TR2 to drop, thereby causing the voltage on line 35 to go negative, and in turn causing the triggering terminal (TRIG) on timer T1 to produce a second output pulse on line 41 to the counter 26. Thus, for the eight foot tube, counter 26 received two counts. During this interval resistor R6 maintains the base of transistor TR2 in a positive mode, and as a consequence timer T2 is not again triggered. After timer T1 finally runs out, and the sensing switch has opened, the circuit returns to its initial conditions ready to repeat the transmission of one or two count signals to the counter 26 depending upon whether or not either a four foot or eight foot tube is crushed.

In practice it is desirable also to detect when the drum 11 (FIG. 1) has become filled, or nearly filled with crushed glass. For this reason the count signal applied by line 41 (FIG. 5) to counter 26 may also be applied to the input of a second counter 51, which is set to count out and energize a warning lamp 52 after a predetermined number of four foot tubes, or equivalents thereof, have been crushed by the mechanism of FIG. 1. Upon replacement of a filled drum 11 with an empty drum, counter 51 would be rest to zero to deenergize lamp 52 until the new drum has been filled.

The following chart, simply by way of example, lists possible values for the components shown in FIG. 5:

| Resistors in Ohms | | | Capacitors in Mfd. | |
|---|---|---|---|---|
| R1 - 120K | R5 - 33K | R10 - 10K | C1 - 0.5 | C5 - .001 |
| R2 - 390K | R6 - 150K | R11 - 470 | C2 - 1.0 | C6 - .01 |
| R3 - 4.7K | R8 - 150K | R11 - 470 | C3 - .01 | C9 - .001 |
| R4 - 120K | R9 - 150K | | C4 - .001 | |

From the foregoing it will be apparent that the present invention provides a relatively simple and inexpensive and very accurate means for automatically sensing and counting the three different types of fluorescent tubes which, as described herein, are suitable for crushing an apparatus of the type shown in FIG. 1 of this application. While the invention has been illustrated and described in connection with four foot, eight foot and U-shaped tubes, it will be apparent, however, that the circuit could be readily adjusted via its timers to accommodate and count fluorescent tubes of still different lengths and configurations. Likewise it will be apparent to one skilled in the art while particular resistors, capacitors, diodes and other circuit elements have been employed to achieve the function described herein, it will be apparent that elements capable of performing similar operations may be substituted without departing from the scope of this invention. Moreover, while this invention has been illustrated and described in detail in connection with only certain embodiments thereof it will be apparent that this invention is capable of still further modification, that this application is intended to cover any such additional embodiments which may fall within the scope of one skilled in the art or the appended claims.

I claim:

1. In a fluorescent lamp crusher of the type having a feed chute for guiding fluorescent lamp tubes of different sizes intermittently and one-by-one to a crusher mechanism to be crushed thereby, improved control apparatus, comprising first signal generating means operative to produce a first signal of a first duration each time a tube of a first size is guided by said chute to said crusher mechanism, and operative to produce a second signal of a second duration longer than said first duration each time a tube of a second size larger than said first size is guided by said chute to said crusher mechanism, and second signal generating means operative upon each production of either of said first and second signals initially to produce a third signal of a third duration shorter than said first duration, said second signal generating means including inhibiting means operative for the duration of one of said first signals, and for a predetermined interval of time thereafter, to inhibit production of a second one of said third signals, whereby each of said first signals produces only one of said third signals.

2. A fluorescent lamp crusher as defined in claim 1, wherein said second signal generating means further includes means operative, prior to the expiration of one of said second signals, and after said predetermined interval of time, to produce a second one of said third signals.

3. A fluorescent lamp crusher as defined in claim 2, including a counter having a signal input and a signal output, and adapted to produce a signal on said output after having a predetermined number of count signals applied to said input, and means for applying each of said third signals as a count signal to said counter input, whereby said counter input receives one count signal for each tube of said first size that is guided to said crusher mechanism, and two count signals for each tube of said larger size.

4. A fluorescent lamp crusher as defined in claim 1, wherein said inhibiting means comprises a fourth signal produced concurrently with said initially produced third signal, and having a duration greater than said first duration and less than said second duration, and said fourth signal being operative upon termination thereof prior to the termination of one of said second signals to produce a second one of said third signals.

5. A fluorescent lamp crusher as defined in claim 1, wherein said second signal generating means comprises a pair of timers each having s signal input and a signal output, means connecting the inputs of said timers to said first signal generating means simultaneously to receive signals therefrom, one of said timers being operative to produce one of said third signals on its output each time one of said first signals is applied to its input, and means operative to produce two of said third signals on the output of said one timer each time one of said second signals is applied to its input.

6. A fluorescent lamp crusher as defined in claim 5, wherein the other of said pair of timers is operative, each time one of said first and second signals is applied to its input, to produce on its output s fourth signal of a duration longer than said first duration and shorter than said second duration, and said inhibiting means includes means interposed between said first signal generating means and the input to said one timer, and operative for the duration of one of said fourth signals to prevent more than one signal from being applied to the input of said one timer.

7. A fluorescent lamp crusher as defined in claim 6, including means operative upon expiration of said fourth signal, during the presence of one of said second signals, to apply a second input signal to said first timer.

8. In a fluorescent lamp crusher having a chute for use in feeding fluorescent lamp tubes of different sizes one-by-one to a crusher mechanism, and a counter for interrupting the operation of the crusher mechanism after a predetermined quantity of count signals have been applied to an input of the counter, improved control apparatus for operating said counter, comprising switch means operative to produce a first signal upon each insertion into said chute of a tube of a first predetermined size, and operative to produce a second signal of longer duration than said first signal, upon each insertion into said chute of a tube of a second size larger than said first size, and control means interposed between said switch means and said counter and responsive to the initial production of each of said first and second signals to apply one count signal to an input of said counter, said control means including inhibit means operative after application of said one count signal to said counter input to inhibit the application of a second count signal to said counter input for a predetermined interval of time greater than the duration of said first signal and less than the duration of said second signal.

9. A fluorescent lamp crusher as defined in claim 8, including means operative upon the initial production of one of said second signals, and the subsequent expiration of said predetermined interval of time, to apply a second count signal to the input of said counter.

10. A fluorescent lamp crusher as defined in claim 8, including a second counter for actuating a warning device after a predetermined quantity of said tubes have been crushed by said crusher mechanism, and means for applying said count signals simultaneously to the input of the first-named counter, and to an input of said second counter.

11. A fluorescent lamp crusher as defined in claim 8, wherein said control means comprises a pair of timers, each having a trigger terminal connected to said switch means, and an output terminal disposed to produce an output signal thereon upon application of a trigger signal to its associated trigger terminal, said switch means being operative upon initial production of each of said first and second signals momentarily to apply a trigger signal to the trigger terminal of each of said timers whereby each of said timers produces an output signal of predetermined duration at its output terminal, means connecting the output signal of one of said timers to the input of said counter, thereby to apply a count signal to the input of said counter each time a signal appears at the output terminal of said one timer, and said inhibit means includes means connecting the output signal of the other of said timers to said trigger terminal of said one timer, and operative to inhibit the application of another trigger signal to the trigger terminal of said one timer for the duration of the output signal from said other timer.

12. A fluorescent lamp crusher as defined in claim 11, wherein the duration of the output signal of said other timer is greater than the duration of the output signal of said one timer.

13. A fluorescent lamp crusher as defined in claim 11, wherein the duration of the output signal of said other timer is equal to said predetermined interval of time.

14. A fluorescent lamp crusher as defined in claim 11 wherein the duration of the output signal of said one timer is less than the duration of said first signal.

* * * * *